United States Patent [19]

Harder et al.

[11] Patent Number: 4,928,601

[45] Date of Patent: May 29, 1990

[54] BIKE MONORAIL SYSTEM

[76] Inventors: Leroy Harder, 232 W. Laurel St., Salinas, Calif. 93906; George Spector, 233 Broadway #3815, New York City, N.Y. 10007

[21] Appl. No.: 377,599

[22] Filed: Jul. 10, 1989

[51] Int. Cl.[5] ..... A63G 1/12

[52] U.S. Cl. ..... 104/53; 104/260; 104/119; 104/135; 104/250; 272/33 B

[58] Field of Search ..... 104/77, 78, 53, 260, 104/259, 60, 63, 64, 73, 118, 121, 119, 135, 250; 272/33 R, 33 B, 34, 35

[56] References Cited

U.S. PATENT DOCUMENTS 639,778 12/1899 Shakespeare ..... 104/119
1,397,939 11/1921 Unger ..... 104/60
4,221,170 9/1980 Koudelka ..... 104/63
4,548,136 10/1985 Yamada ..... 104/53

FOREIGN PATENT DOCUMENTS 1397053 5/1988 U.S.S.R. ..... 272/33 B
0013843 of 1896 United Kingdom ..... 272/33 B

*Primary Examiner*—Andres Kashnikow
*Assistant Examiner*—Mark T. Le

[57] ABSTRACT

A bicycle monorail system is provided and consists of a series of bicycles which are to be peddled by riders to run about an elevated monorail track having an irregular continuous path. Each bicycle includes a structure thereon to prevent another bicycle from behind to bump into it.

1 Claim, 1 Drawing Sheet

BIKE MONORAIL SYSTEM

BACKGROUND OF THE INVENTION

The instant invention relates generally to amusement devices and more specifically it relates to a bicycle monorail system.

Numerous amusement devices have been provided in prior art that are adapted to include a number of cycles which are ridden around a circular path to give pleasure to the riders of the cycles. For example, U.S. Pat. Nos. 480,477 to Schafer; 665,393 to Barto and 832,902 to Hambright et al all are illustrative of such prior art. While these units may be suitable for the particular purpose to which they address, they would not be as suitable for the purposes of the present invention as heretofore described.

SUMMARY OF THE INVENTION

A primary object of the present invention is to provide a bicycle monorail system that will overcome the shortcomings of the prior art devices.

Another object is to provide a bicycle monorail system that will utilize a series of bicycles which are to be peddled by riders to run about an elevated monorail track having an irregular continuous path.

An additional object is to provide a bicycle monorail system in which each bicycle will have a structure thereon to prevent another bicycle behind it from bumping into it.

A further object is to provide a bicycle monorail system that is simple and easy to use.

A still further object is to provide a bicycle monorail system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
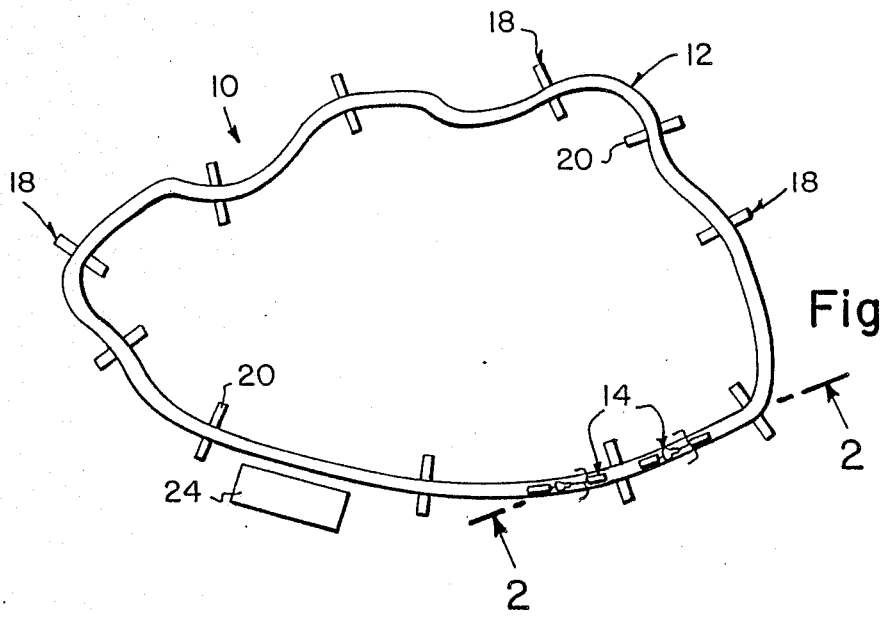
FIG. 1 is a top plan view of the monorail track of the invention.
Figure 2:
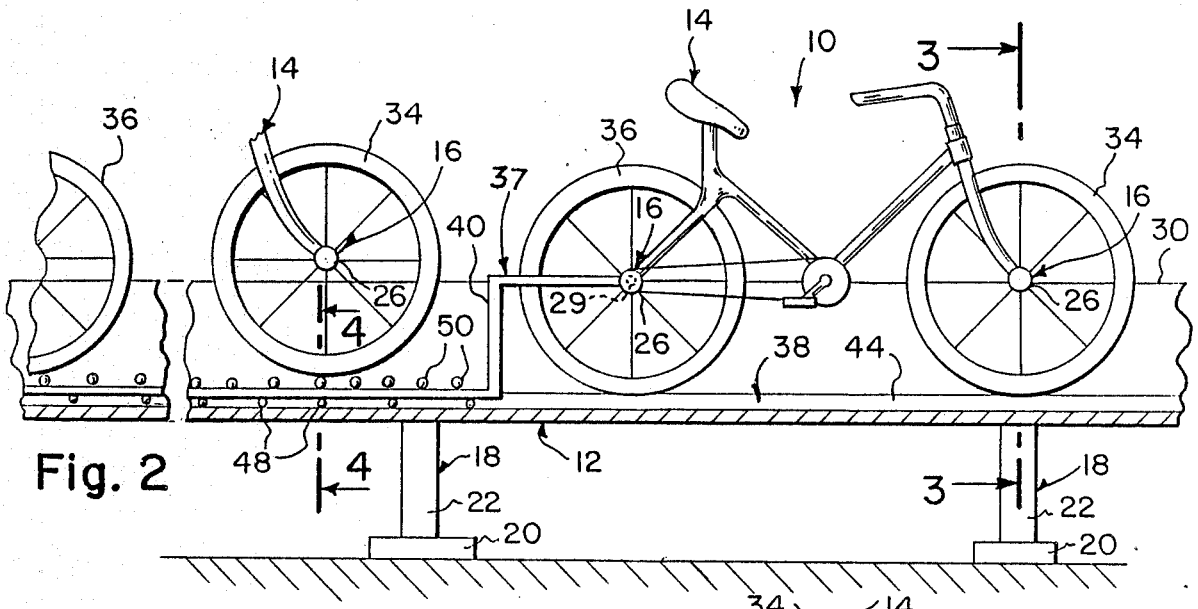
FIG. 2 is a cross sectional view taken along line 2—2 in FIG. 1, showing the mechanism for preventing a first bicycle from bumping into a second bicycle ahead of it.
Figure 3:
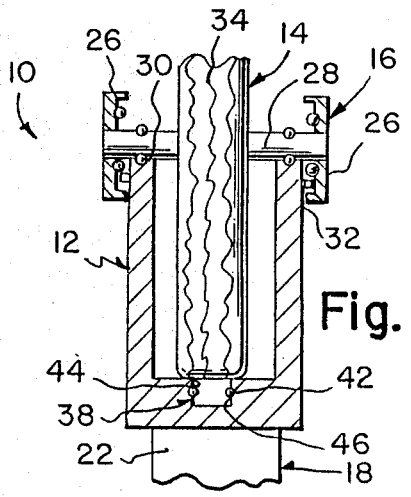
FIG. 3 is a cross sectional view taken along line 3—3 in FIG. 2, showing the mechanism on front wheel axle for keeping the bicycle centered within the monorail track.
Figure 4:
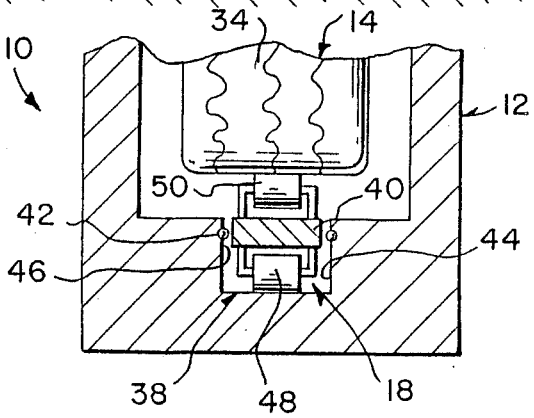
FIG. 4 is a cross sectional view taken along line 4—4 in FIG. 2, showing the front wheel of the first bicycle elevated from bottom of the monorail track by the roller on the bumping preventing mechanism.

Turning now descriptively to the drawings, in which similar reference characters denote similar elements throughout the several views, the Figures illustrate a bicycle monorail system 10 that consists of a monorail track 12 having an irregular continuous path and bicycles 14 peddled by riders to run within the monorail track 12 along the irregular continuous path. A mechanism 16 is carried on each of the bicycles 14 for keeping the bicycles centered within the monorail track 12. Another mechanism 37 is provided for preventing the bicycles 14 from bumping into each other on the monorail track 12.

The system 10 also includes a plurality of spaced apart support stands 18. Each stand has a base portion 20 and an upright post 22 to elevate the entire monorail track 12. A loading platform 24 is disposed near the monorail track 12 so that the riders can get on and get off the bicycles 14.

The centering mechanism 16 includes a ball bearing race 26 carried on each opposite distal end of the front and rear axles 28 and 29 of the bicycles 14 which will bear against top edges 30 and side edges 32 of the monorail track 12 to keep front wheels 34 and rear wheels 36 of the bicycles 14 centered therein.

The bumping preventing mechanism 37 includes the monorail track 12 having a centered narrow bottom recess 38 which runs parallel therealong. A pair of Z-shaped drag bars 40 are provided with each extending from rear axle 29 on one of the bicycles 14 and goes within the bottom recess 38. Ball bearings 42 are carried within opposite side walls 44 and 46 of the bottom recess 38 to guide the drag bars 40. A first set of rollers 48 are carried on bottom surface of each of the drag bars 40 to ride within the bottom recess 38 of the monorail track 12. A second set of rollers 50 are carried on top surface of each of the drag bars 40 so that if the bicycles 14 get too close to each other the front and rear wheels 34 and 36 of one of the bicycles 14 will ride upon the second set of rollers 50 instead of bottom 52 of the monorail track 12 to prevent the bicycles 14 from bumping against each other.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bicycle monorail system which comprises:

(a) a monorail track having an irregular continuous path;

(b) at least two bicycles, each peddled by a rider to run within said monorail track along said irregular continuous path;

(c) means carried on each of said bicycles for keeping said bicycles centered within said monorail track;

(d) means for preventing said first and second bicycles from bumping into each other on said monorail track;

(e) a plurality of spaced apart support stands, each having a base portion and an upright post so as to elevate the entire monorail track and (f) a loading platform disposed near said monorail track so that the riders can get on and get off said bicycles; wherein said centering means includes a ball bearing race carried on each opposite distal end of front and rear axles of said bicycles which will bear against top edges and side edges of said monorail track to keep front wheels and rear wheels of said bicycles centered therein; wherein said bumping preventing means includes:

(g) said monorail track having a centered narrow bottom recess which runs parallel therealong;

(h) a pair of elongated Z-shaped drag bars each extending from rear axle on one of said bicycles and goes within said bottom recess;

(i) ball bearings carried within opposite side walls of said bottom recess to guide said drag bars;

(j) a first set of rollers carried on bottom surface of each of said drag bars to ride within said bottom recess of said monorail track and (k) a second set of rollers carried on top surface of each of said drag bars so that if said bicycles gets close to each other the front and rear wheels of one of said bicycles will ride upon said second set of rollers instead of bottom of said monorail track to prevent said bicycles from bumping against each other.

* * * * *